US007396370B2

(12) United States Patent
Grüner et al.

(10) Patent No.: US 7,396,370 B2
(45) Date of Patent: Jul. 8, 2008

(54) METHOD OF DYEING OR PRINTING SYNTHETIC POLYAMIDE FIBRE MATERIALS USING REACTIVE DYES

(75) Inventors: Franz Grüner, Schopfheim (DE); Jürgen Schmiedl, Steinen (DE); Ulrich Fembacher, Wertingen (DE); Ulrich Strahm, Aesch (CH)

(73) Assignee: Huntsman International LLC, The Woodlands, TX (US)

( * ) Notice: Subject to any disclaimer, the term of this patent is extended or adjusted under 35 U.S.C. 154(b) by 32 days.

(21) Appl. No.: 10/517,234

(22) PCT Filed: Jun. 3, 2003

(86) PCT No.: PCT/EP03/05802

§ 371 (c)(1), (2), (4) Date: Dec. 7, 2004

(87) PCT Pub. No.: WO03/104546

PCT Pub. Date: Dec. 18, 2003

(65) Prior Publication Data

US 2005/0235435 A1 Oct. 27, 2005

(30) Foreign Application Priority Data

Jun. 10, 2002 (EP) ..... 02405468

(51) Int. Cl.
*D06P 1/38* (2006.01)

(52) U.S. Cl. ..... 8/543; 8/549; 8/115.51; 8/115.54; 8/531; 8/924

(58) Field of Classification Search ..... 8/543–9, 8/618, 115.51, 115.54, 531, 549, 924; 534/612; 544/189

See application file for complete search history.

(56) References Cited

U.S. PATENT DOCUMENTS

| | | | | | |
|---|---|---|---|---|---|
| 3,170,911 | A | * | 2/1965 | Wasem et al. | 534/638 |
| 3,445,451 | A | * | 5/1969 | St. Alban et al. | 534/642 |
| 3,459,729 | A | * | 8/1969 | Crotti et al. | 534/776 |
| 3,558,670 | A | * | 1/1971 | Hohmann et al. | 552/235 |
| 3,716,330 | A | * | 2/1973 | Kitamura et al. | 8/552 |
| 3,988,108 | A | | 10/1976 | Segoshi et al. | 8/18 |
| 5,037,965 | A | * | 8/1991 | Morimitsu et al. | 534/612 |
| 5,760,194 | A | | 6/1998 | Lehmann et al. | 534/636 |
| 5,760,195 | A | | 6/1998 | Lehmann et al. | 534/638 |
| 5,779,740 | A | | 7/1998 | Lehmann et al. | 8/549 |
| 5,973,147 | A | * | 10/1999 | Lehmann et al. | 544/189 |
| 6,504,016 | B2 | | 1/2003 | Tzikas et al. | 534/637 |
| 6,930,179 | B2 | * | 8/2005 | Schmiedl et al. | 534/638 |
| 2002/0138922 | A1 | * | 10/2002 | Schmiedl et al. | 8/543 |
| 2003/0097721 | A1 | | 5/2003 | Schmiedl et al. | 8/445 |

FOREIGN PATENT DOCUMENTS

| | | | |
|---|---|---|---|
| DE | 1944596 | | 3/1970 |
| DE | 2615759 | | 10/1976 |
| EP | 1207186 | | 5/2002 |
| EP | 1275700 | * | 1/2003 |
| GB | 1275739 | | 5/1972 |
| GB | 1524911 | | 9/1978 |

* cited by examiner

*Primary Examiner*—Lorna M. Douyon
*Assistant Examiner*—Tri V Nguyen

(57) ABSTRACT

A method of dyeing or printing synthetic polyamide fiber materials, wherein (a) the fiber material is dyed or printed with at least one reactive dye, and (b) the dyed or printed fiber material is subjected to after-treatment with a reducing agent, the fiber material not being treated with polycondensable or polymerizable compounds for fixing the dye on the fiber, results in dyeings and printings that are distinguished by good fastness properties.

6 Claims, No Drawings

METHOD OF DYEING OR PRINTING SYNTHETIC POLYAMIDE FIBRE MATERIALS USING REACTIVE DYES

The present invention relates to a method of dyeing or printing synthetic polyamide fibre materials using reactive dyes.

The problem underlying the present invention was to make available a simplified, easily carried-out method of dyeing or printing synthetic polyamide fibre materials which results in fibre materials that have very good fastness properties.

The bleaching of wool by destroying the yellow chromophores by means of reduction, thereby counteracting yellowing of the wool during processing, is known.

It is also known that, for the improvement of fastness properties, dyed polyester fibres or polyester blend fibres are freed from superficially adhering dispersion dyes by means of subsequent reductive cleaning.

The present invention does not relate to the dyeing of polyester blend fibres in the presence of dispersion dyes.

From U.S. Pat. No. 3,988,108 it is known that, for enhancing the brilliance of colours and the fastness properties, dyed fibre materials are subjected to after-treatment with a reducing agent so that the unfixed dye components, which dull the colour and impair the fastness properties, are removed reductively. However, in the method of the prior art it is imperative, in order to obtain good results, that the fibre material be treated with polymerisable or polycondensable monomers in the presence of a catalyst before, during or after the dyeing step, that is to say before the after-treatment with reducing agent, so that lasting fixing of the dyes on the fibre is achieved.

It has now been found, surprisingly, that, when dyeing synthetic polyamide fibre materials, treatment of the fibre materials with prepolymers or precondensation products can be omitted when synthetic polyamide fibre material is dyed with reactive dyes according to the present invention.

The problem posed is solved, in accordance with the invention, by the method described hereinbelow.

The dyeings obtained solve the posed problem in outstanding manner. In particular, the dyeings obtained are distinguished by very good fastness properties and brilliant colours.

The present invention accordingly relates to a method of dyeing or printing synthetic polyamide fibre materials, wherein (a) the fibre material is dyed or printed with at least one reactive dye, and (b) the dyed or printed fibre material is subjected to after-treatment with a reducing agent, the fibre material not being treated with polycondensable or polymerisable compounds for fixing the dye on the fibre, and wherein blend fibres of polyester and polyamide are excluded.

Reactive dyes contain at least one fibre-reactive radical. Fibre-reactive radicals are to be understood in general as being those which are capable of reacting with the hydroxy groups of cellulose, with the amino, carboxy, hydroxy and thiol groups in wool and silk, or with the amino and possibly carboxy groups of synthetic polyamides to form covalent chemical bonds. The fibre-reactive radicals are generally bonded to the dye radical directly or via a bridging member. Suitable fibre-reactive radicals are, for example, those having at least one removable substituent at an aliphatic, aromatic or heterocyclic radical or those wherein the mentioned radicals contain a radical suitable for reaction with the fibre material, for example a vinyl radical.

Reactive dyes are known and are described in large numbers, for example in Venkataraman "The Chemistry of Synthetic Dyes" Volume 6, Academic Press, New York, London 1972.

In a preferred embodiment of the method according to the invention there is used at least one reactive dye of formula $$A\text{-}(Z)_k \qquad (1),$$

wherein

A is the radical of a monoazo, disazo, polyazo, metal complex azo, anthraquinone, phthalocyanine, formazan or dioxazine dye, Z independently denotes k fibre-reactive substituents, which may be identical or different from one another, selected from the group of the vinylsulfonyl, acryloyl and heterocyclic series, and k is a number 1, 2 or 3.

Fibre-reactive radicals Z from the group of the vinylsulfonyl series are, for example, alkylsulfonyl radicals substituted by a removable atom or by a removable group or alkenylsulfonyl radicals which are unsubstituted or substituted by a removable atom or by a removable group. The said alkylsulfonyl and alkenylsulfonyl radicals contain generally from 2 to 8, preferably from 2 to 4, and especially 2, carbon atoms.

Fibre-reactive radicals Z from the group of the acryloyl series are, for example, alkanoyl radicals substituted by a removable atom or by a removable group or alkenoyl radicals which are unsubstituted or substituted by a removable atom or by a removable group. The said alkanoyl and alkenoyl radicals contain generally from 2 to 8, preferably 3 or 4, and especially 3, carbon atoms.

Examples of suitable fibre-reactive radicals Z from the group of the heterocyclic series include heterocyclic radicals that contain 4-, 5- or 6-membered rings and that are substituted by a removable atom or by a removable group. Suitable heterocyclic radicals are, for example, those that contain at least one removable substituent bonded to a heterocyclic radical, inter alia those that contain at least one reactive substituent bonded to a 5- or 6-membered heterocyclic ring, for example to a monoazine, diazine, pyridine, pyrimidine, pyridazine, pyrazine, thiazine, oxazine or asymmetrical or symmetrical triazine ring, or to such a ring system that has one or more fused-on aromatic rings, for example a quinoline, phthalazine, quinazoline, quinoxaline, acridine, phenazine or phenanthridine ring system.

Removable atoms and removable groups or leaving groups are, for example, halogen, e.g. fluorine, chlorine or bromine, ammonium, including hydrazinium, sulfato, thiosulfato, phosphato, acetoxy, propionyloxy, azido, carboxypyridinium or rhodanido.

As a radical from the group of the vinylsulfonyl series, Z is preferably a radical $—SO_2—CH{=}CH_2$ or $SO_2—CH_2—CH_2—U$ wherein U is a leaving group.

As a radical from the group of the acryloyl series, Z is preferably a radical $—CO—CH(Hal)\text{-}CH_2(Hal)$ or $—CO—C(Hal){=}CH_2$ wherein Hal is chlorine or bromine.

As a radical from the group of the heterocyclic series, Z is preferably a halotriazine or halopyrimidine radical, especially a halotriazine radical, wherein the halogen is fluorine or chlorine.

Z is preferably $—SO_2—CH{=}CH_2$ or $—SO_2—CH_2—CH_2—U$, wherein U is a leaving group, $—CO—CH(Hal)\text{-}CH_2(Hal)$ or $—CO—C(Hal){=}CH_2$, wherein Hal is chlorine or bromine, or a halotriazine radical, wherein the halogen is fluorine or chlorine.

The fibre-reactive radicals Z and the dye radical A may be connected to one another by way of a bridging member. Suitable bridging members include, besides a direct bond or, for example, an amino group, a very wide variety of radicals. For example, the bridging member is an aliphatic, aromatic or heterocyclic radical; the bridging member may also be composed of various such radicals. The bridging member generally contains at least one functional group, for example the carbonyl group or the amino group, it being possible for the amino group to be substituted by $C_1$-$C_4$alkyl which is unsubstituted or further substituted by halogen, hydroxy, cyano, $C_1$-$C_4$alkoxy, $C_1$-$C_4$alkoxycarbonyl, carboxy, sulfamoyl, sulfo or by sulfato. A suitable aliphatic radical is, for example, an alkylene radical having from 1 to 7 carbon atoms, or a branched isomer thereof. The carbon chain of the alkylene radical may be interrupted by a hetero atom, for example an oxygen atom. A suitable aromatic radical is, for example, a phenyl radical which may be substituted by $C_1$-$C_4$alkyl, e.g. methyl or ethyl, $C_1$-$C_4$alkoxy, e.g. methoxy or ethoxy, halogen, e.g. fluorine, bromine or, especially, chlorine, carboxy or by sulfo, and a suitable heterocyclic radical is, for example, a piperazine radical.

Such fibre-reactive radicals Z are known per se and large numbers of them are described, for example in Venkataraman "The Chemistry of Synthetic Dyes" Volume 6, pages 1-209, Academic Press, New York, London 1972 or in EP-A-625 549 and U.S. Pat. No. 5,684,138.

k preferably denotes a number 2 or 3, especially 2.

When k denotes a number 2 or 3, preference is given to at least one of the fibre-reactive radicals Z being a radical from the group of the heterocyclic series, for example a halotriazine radical.

In an especially preferred embodiment of the method according to the invention, there is used a reactive dye of formula (1a)

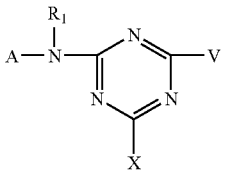

wherein $R_1$ is hydrogen or unsubstituted or substituted $C_1$-$C_4$alkyl,

X is halogen,

A is as defined above, and

V is a non-fibre-reactive substituent or is a fibre-reactive substituent of formula (2a)

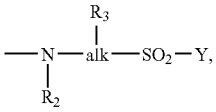

(2b)

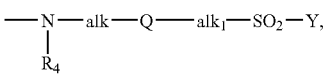

(2c)

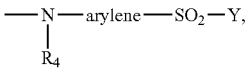

-continued (2d)

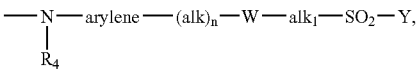

(2e)

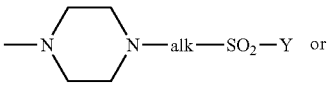

or (2f)

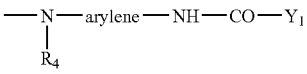

wherein $R_2$ is hydrogen or unsubstituted or substituted $C_1$-$C_4$alkyl or a radical

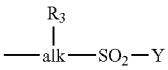

wherein $R_3$ is as defined below, $R_3$ is hydrogen, hydroxy, sulfo, sulfato, carboxy, cyano, halogen, $C_1$-$C_4$alkoxycarbonyl, $C_1$-$C_4$-alkanoyloxy carbamoyl or a group —$SO_2$—Y, $R_4$ is hydrogen or $C_1$-$C_4$alkyl, alk and $alk_1$ are each independently of the other linear or branched $C_1$-$C_6$alkylene, arylene is a phenylene or naphthylene radical which is unsubstituted or substituted by sulfo, carboxy, hydroxy, $C_1$-$C_4$alkyl, $C_1$-$C_4$alkoxy or by halogen, Y is vinyl or a radical —$CH_2$—$CH_2$—U and U is a leaving group, $Y_1$ is a group —CH(Hal)-$CH_2$(Hal) or —C(Hal)=$CH_2$ wherein Hal is chlorine or bromine, W is a group —$SO_2$—$NR_4$—, —$CONR_4$— or —$NR_4$CO— wherein $R_4$ is as defined above, Q is a radical —O— or —$NR_4$— wherein $R_4$ is as defined above, and n is a number 0 or 1.

If desired, a fibre-reactive radical, for example having the definitions and preferred meanings given above for Z, is bonded to the dye radical A.

Preferably, one of the radicals A and V in the reactive dyes of formula (1a) used in accordance with the invention, especially only the radical V, contains a fibre-reactive radical.

As $C_1$-$C_4$alkyl for $R_1$, $R_2$ and $R_4$, each independently of the others, there come into consideration, for example, methyl, ethyl, propyl, isopropyl, n-butyl, sec-butyl, tert-butyl or isobutyl, preferably methyl or ethyl, and especially methyl. The said radicals $R_1$ and $R_2$ are unsubstituted or substituted, for example by halogen, hydroxy, cyano, $C_1$-$C_4$alkoxy, $C_1$-$C_4$-alkoxycarbonyl, carboxy, sulfamoyl, sulfo or by sulfato, preferably by hydroxy, sulfo, sulfato, carboxy or by cyano. The unsubstituted radicals are preferred.

X is, for example, fluorine, chlorine or bromine, preferably fluorine or chlorine, and especially chlorine.

$R_1$ is preferably hydrogen or $C_1$-$C_4$alkyl, especially hydrogen, methyl or ethyl, and very especially hydrogen.

When Y is a radical —$CH_2$—$CH_2$—U, the leaving group U may be, for example, —Cl, —Br, —F, —$OSO_3H$, —$SSO_3H$, —OCO—$CH_3$, $OPO_3H_2$, —OCO—$C_6H_5$, $OSO_2$—$C_1$-$C_4$alkyl or —$OSO_2$—N($C_1$-$C_4$alkyl)$_2$. U is preferably a group of formula —Cl, —$OSO_3H$, —$SSO_3H$, —OCO—

$CH_3$, —OCO—$C_6H_5$ or —$OPO_3H_2$, especially —Cl or —$OSO_3H$, and more especially —$OSO_3H$.

Y is preferably vinyl, β-chloroethyl, β-sulfatoethyl, β-thiosulfatoethyl, β-acetoxyethyl, β-phenoxyethyl or β-phosphatoethyl, especially β-chloroethyl, β-sulfatoethyl or vinyl, more especially β-sulfatoethyl or vinyl, and very especially vinyl.

Hal is preferably bromine.

alk and $alk_1$, each independently of the other, are, for example, methylene, 1,2-ethylene, 1,3-propylene, 1,4-butylene, 1,5-pentylene, 1,6-hexylene or branched isomers thereof. alk and $alk_1$, each independently of the other, are preferably a $C_1$-$C_4$alkylene radical, and especially an ethylene or propylene radical.

Preferred meanings of arylene are a 1,3- or 1,4-phenylene radical which is unsubstituted or substituted by sulfo, methyl or by methoxy, and especially an unsubstituted 1,3- or 1,4-phenylene radical.

$R_2$ is preferably hydrogen, $C_1$-$C_4$alkyl or a radical of formula

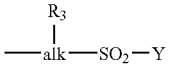

wherein $R_3$, Y and alk in each case are as defined above and have the preferred meanings given above. $R_2$ is especially hydrogen, methyl or ethyl, and very especially hydrogen.

$R_3$ is preferably hydrogen.

$R_4$ is preferably hydrogen, methyl or ethyl, and especially hydrogen.

The variable Q is preferably —NH— or —O—, and especially —O—.

W is preferably a group of formula —CONH— or —NHCO—, especially the group of formula —CONH—.

The variable n is preferably the number 0.

Preferred fibre-reactive substituents V of formulae (2a) to (2f) are those wherein $R_2$, $R_3$ and $R_4$ are each hydrogen, Q is a radical —NH— or —O—, W is the group —CONH—, alk and $alk_1$ are each independently of the other ethylene or propylene, arylene is phenylene which is unsubstituted or substituted by methyl, methoxy or by sulfo, Y is vinyl, β-chloroethyl or β-sulfatoethyl, especially vinyl or β-sulfatoethyl, and very especially vinyl, $Y_1$ is —CHBr—$CH_2$Br or —CBr=$CH_2$ and n is the number 0; amongst those substituents special preference is given to the radicals of formulae (2c) and (2d).

When V has the meaning of a fibre-reactive substituent, very special preference is given to V being a group of formula

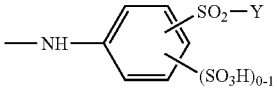

(2c')

or

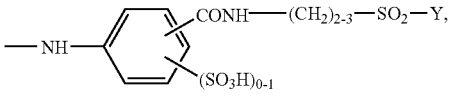

(2d')

especially (2c'), Y being as defined above and having the preferred meanings given above.

An especially important fibre-reactive substituent V is the radical of formula

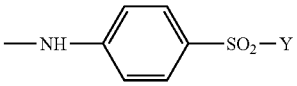

(2c")

wherein Y is vinyl or β-sulfatoethyl, especially vinyl.

When V is a non-fibre-reactive substituent, it may be, for example, hydroxy; $C_1$-$C_4$alkoxy; $C_1$-$C_4$alkylthio which is unsubstituted or substituted by hydroxy, carboxy or by sulfo; amino; amino mono- or di-substituted by $C_1$-$C_8$alkyl, the alkyl(s) being unsubstituted or further substituted by, for example, sulfo, sulfato, hydroxy, carboxy or by phenyl, especially by sulfo or by hydroxy, and being uninterrupted or interrupted by a radical —O—; cyclohexylamino; morpholino; N—$C_1$-$C_4$alkyl-N-phenylamino or phenylamino or naphthylamino, the phenyl or naphthyl being unsubstituted or substituted by, for example, $C_1$-$C_4$alkyl, $C_1$-$C_4$alkoxy, carboxy, sulfo or by halogen.

Examples of suitable non-fibre-reactive substituents V are amino, methylamino, ethylamino, β-hydroxyethylamino, N,N-di-β-hydroxyethylamino, β-sulfoethylamino, cyclohexylamino, morpholino, o-, m- or p-chlorophenylamino, o-, m- or p-methylphenylamino, o-, m- or p-methoxyphenylamino, o-, m- or p-sulfophenylamino, disulfophenylamino, o-carboxyphenylamino, 1- or 2-naphthylamino, 1-sulfo-2-naphthylamino, 4,8-disulfo-2-naphthylamino, N-ethyl-N-phenylamino, N-methyl-N-phenylamino, methoxy, ethoxy, n- or iso-propoxy and hydroxy.

As a non-fibre-reactive radical preference is given to V in the meaning of $C_1$-$C_4$alkoxy, $C_1$-$C_4$-alkylthio which is unsubstituted or substituted by hydroxy, carboxy or by sulfo, hydroxy, amino, N-mono- or N,N-di-$C_1$-$C_4$alkylamino which is unsubstituted or substituted in the alkyl moiety/moieties by hydroxy, sulfato or by sulfo, morpholino, phenylamino or N—$C_1$-$C_4$alkyl-N-phenylamino (wherein the alkyl is unsubstituted or substituted by hydroxy, sulfo or by sulfato) which is unsubstituted or substituted in the phenyl ring by sulfo, carboxy, chlorine, acetylamino, methyl or by methoxy, or naphthylamino which is unsubstituted or substituted by from 1 to 3 sulfo groups.

Especially preferred non-fibre-reactive radicals V are amino, N-methylamino, N-ethylamino, morpholino, phenylamino, 2-, 3- or 4-sulfophenylamino, naphthylamino, 1-sulfonaphth-2-yl-amino, 3,7-disulfonaphth-2-yl-amino or N—$C_1$-$C_4$alkyl-N-phenylamino.

When A is the radical of a monoazo, polyazo or metal complex azo chromophore, the following radicals, especially, come into consideration:

chromophore radicals of a mono- or dis-azo dye of formula $$D\text{-}N{=}N\text{-}(M\text{-}N{=}N)_u\text{-}K\text{-} \quad (3) \text{ or}$$

$$\text{-}D\text{-}N{=}N\text{—}(M\text{-}N{=}N)_u\text{-}K \quad (4)$$

wherein D is the radical of a diazo component, of the benzene or naphthalene series, M is the radical of a central component, of the benzene or naphthalene series, K is the radical of a coupling component, of the benzene, naphthalene, pyrazolone, 6-hydroxypyrid-2-one or acetoacetic acid arylamide series, and u is a number 0 or 1, wherein D, M and K may carry substituents customary for azo dyes, for example $C_1$-$C_4$alkyl or $C_1$-$C_4$alkoxy each of which is unsubstituted or further substituted by hydroxy, sulfo or by sulfato, halogen, carboxy, sulfo, nitro, cyano, trifluoromethyl, sulfamoyl, carbamoyl, amino, ureido, hydroxy, carboxy, sulfomethyl, $C_2$-$C_4$alkanoylamino, benzoylamino which is unsubstituted or substituted in the phenyl ring by $C_1$-$C_4$alkyl, $C_1$-$C_4$alkoxy, halogen or by sulfo, phenyl which is unsubstituted or substituted by $C_1$-$C_4$alkyl, $C_1$-$C_4$alkoxy, halogen, carboxy or by sulfo, and also fibre-reactive radicals. There also come into consideration the metal complexes derived from the dye radicals of formulae (3) and (4), especially dye radicals of a 1:1 copper complex azo dye or 1:2 chromium complex azo dye, of the benzene or naphthalene series, wherein the copper or chromium atom is in each case bonded, on either side in the position ortho to the azo bridge, to a group capable of being metallated.

When the chromophore radicals of formula (3) or (4) carry a reactive radical, the reactive radical may correspond, for example, to formula $$-SO_2-Y, \quad (5a)$$

$$-CONH-(CH_2)_m-SO_2-Y, \quad (5b)$$

$$-CONH-(CH_2)_l-O-(CH_2)_m-SO_2-Y, \quad (5c)$$

$$-NHCO-(CH_2)_m-SO_2-Y, \quad (5d)$$

$$-(O)_p-(CH_2)_q-CONH-(CH_2)_m-SO_2-Y, \quad (5e)$$

$$-NH-CO-CH(Hal)-CH_2(Hal), \quad (5f)$$

$$-NH-CO-C(Hal)=CH_2 \text{ or} \quad (5g)$$

(5h)

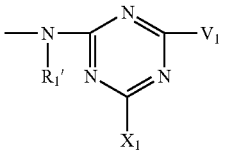

wherein Y and Hal each are as defined above and have the preferred meanings given above, $V_1$ independently has the definitions and preferred meanings given above for V, $X_1$ independently has the definitions and preferred meanings given above for X, $R_1$' independently has the definitions and preferred meanings given above for $R_1$, and p is a number 0 or 1, and l, m and q are each independently of the others an integer from 1 to 6. Preferably, p is the number 0, l and m are each independently of the other a number 2 or 3, and q is a number 1, 2, 3 or 4.

As reactive radicals for the chromophore radicals of formula (3) or (4) there comes into consideration, especially, a radical of formula (5a), (5d), (5f), (5g) or (5h) given above, especially of formula (5a) or (5h).

Preferably, the chromophore radicals A of formula (3) or (4) do not carry a reactive radical.

Especially preferred radicals of a monoazo or disazo chromophore A are the following:

(6a)

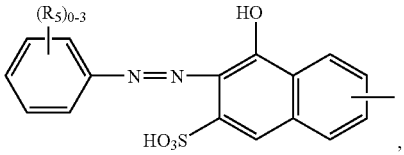

-continued (6b)

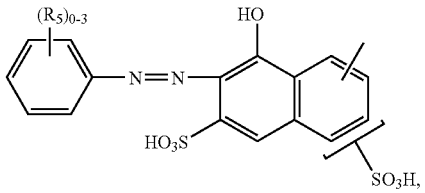

(6c)

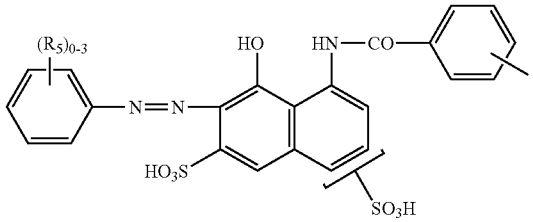

wherein $(R_5)_{0-3}$ denotes from 0 to 3 identical or different substituents from the group $C_1$-$C_4$alkyl, $C_1$-$C_4$alkoxy, halogen, carboxy and sulfo, (6d)

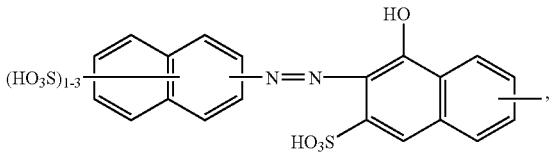

(6e)

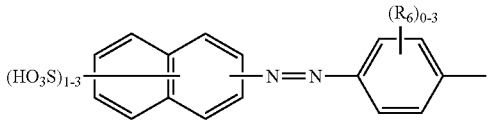

wherein $(R_6)_{0-3}$ denotes from 0 to 3 identical or different substituents from the group halogen, nitro, cyano, trifluoromethyl, sulfamoyl, carbamoyl, $C_1$-$C_4$alkyl, $C_1$-$C_4$alkoxy, amino, $C_2$-$C_4$-alkanoylamino, ureido, hydroxy, carboxy, sulfomethyl and sulfo, (6f)

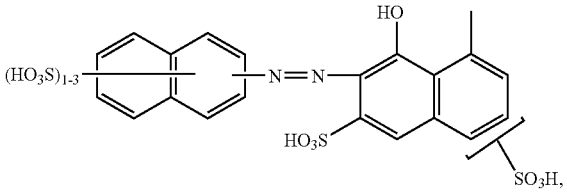

(6g)

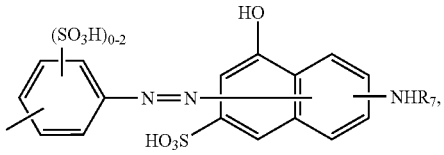

-continued (6h)

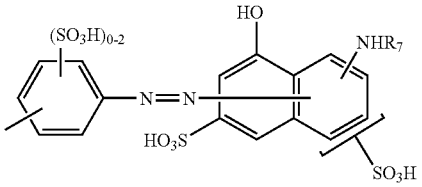

wherein $R_7$ is hydrogen, $C_1$-$C_4$alkyl, $C_1$-$C_4$alkanoyl, benzoyl or a reactive radical of formula (5d) or (5h) given above, (6i)

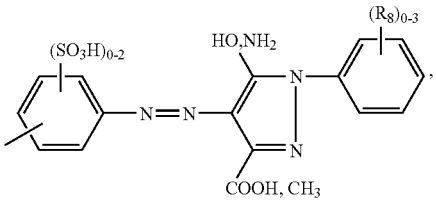

-continued (6j)

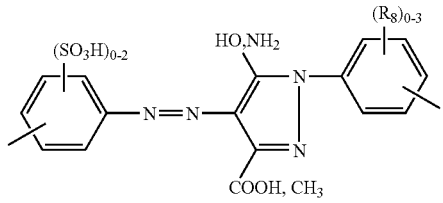

wherein $(R_8)_{0-3}$ denotes from 0 to 3 identical or different substituents from the group $C_1$-$C_4$alkyl, $C_1$-$C_4$alkoxy, halogen, carboxy and sulfo, (6k)

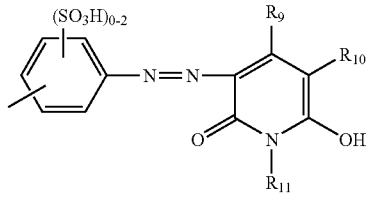

wherein $R_9$ and $R_{11}$ are each independently of the other hydrogen, $C_1$-$C_4$alkyl or phenyl and $R_{10}$ is hydrogen, cyano, carbamoyl or sulfomethyl, (6l)

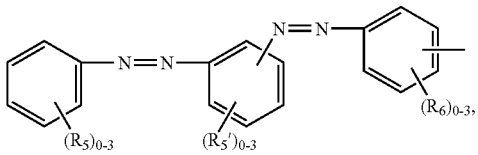

(6m)

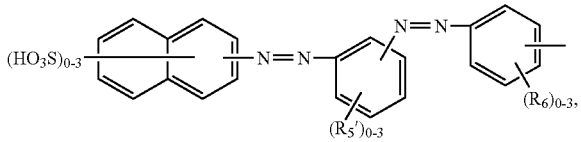

(6n)

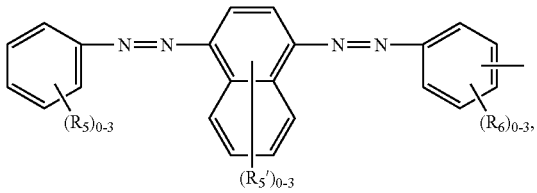

(6o)

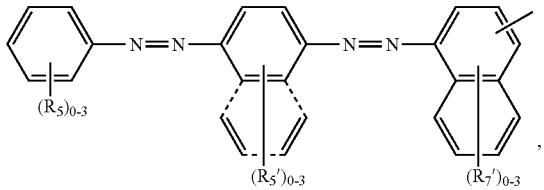

-continued (6p)

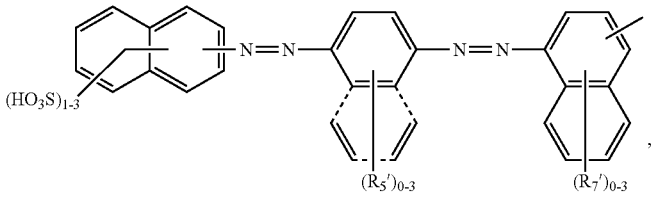

(6q)

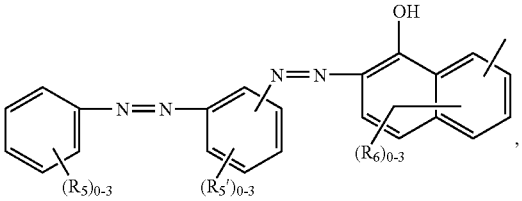

(6r)

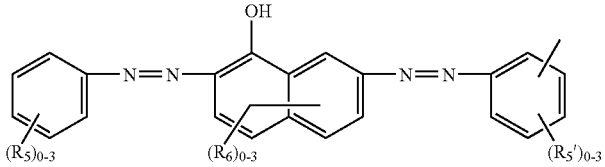

or (6s)

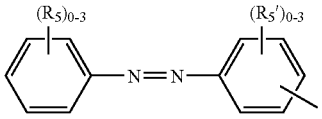

wherein $(R_5)_{0-3}$ and $(R_6)_{0-3}$ are as defined above, $(R_5')_{0-3}$ denotes from 0 to 3 identical or different substituents from the group $C_1$-$C_4$alkyl, $C_1$-$C_4$alkoxy, $C_2$-$C_4$alkanoylamino, ureido, halogen, carboxy, sulfo, $C_1$-$C_4$hydroxyalkoxy and $C_1$-$C_4$sulfatoalkoxy, and $(R_7')_{0-3}$ denotes from 0 to 3 identical or different substituents from the group $C_1$-$C_4$alkyl, $C_1$-$C_4$alkoxy, halogen, carboxy and sulfo, and Y is as defined above.

The radicals of formulae (6a), (6b), (6c), (6d), (6e), (6f), (6i), (6j), (6l), (6m), (6n), (6o), (6p), (6q), (6r) and (6s) may also contain, as a further substituent, in the phenyl or naphthyl rings, a fibre-reactive radical of formula (5a), (5b), (5c), (5d), (5e), (5f) or (5g) wherein the variables are as defined above and have the preferred meanings given above. Preferably, they do not contain a fibre-reactive radical.

The radical of a formazan dye A is preferably a dye radical of formula (7a)

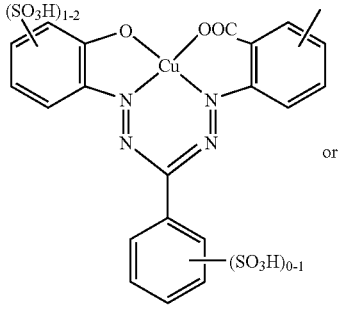

or

-continued (7b)

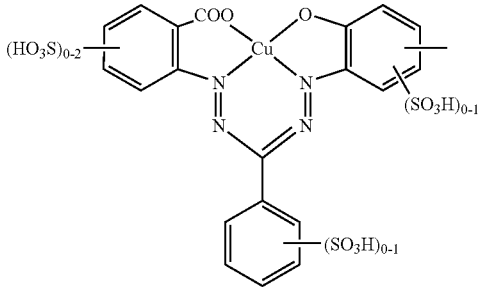

wherein the benzene nuclei contain no further substituents or are further substituted by $C_1$-$C_4$alkyl, $C_1$-$C_4$alkoxy, $C_1$-$C_4$alkylsulfonyl, halogen or by carboxy.

When A is the radical of a phthalocyanine dye, it is preferably a radical of formula (8)

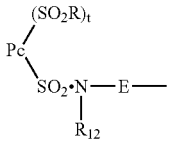

wherein Pc is the radical of a metal phthalocyanine, especially the radical of a copper or nickel phthalocyanine; R is —OH and/or —$NR_{13}R_{14}$; $R_{13}$ and $R_{14}$ are each independently of the other hydrogen or $C_1$-$C_4$alkyl which is unsubstituted or substituted by hydroxy or by sulfo; $R_{12}$ is hydrogen or $C_1$-$C_4$alkyl; E is a phenylene radical which is unsubstituted or substituted by $C_1$-$C_4$alkyl, halogen, carboxy or by sulfo or is a $C_2$-$C_6$alkylene radical; and t is 1 to 3. $R_{13}$ and $R_{14}$ are preferably hydrogen. E is preferably a phenylene radical which is unsubstituted or substituted by $C_1$-$C_4$alkyl, halogen, carboxy or by sulfo. Pc is preferably the radical of a copper phthalocyanine.

When A is the radical of a dioxazine dye, it is, for example, a radical of formula (9)

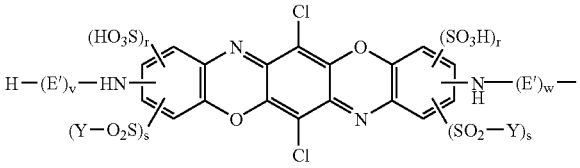

wherein E' is a phenylene radical which is unsubstituted or substituted by $C_1$-$C_4$alkyl, halogen, carboxy or by sulfo or is a $C_2$-$C_6$alkylene radical, r, s, v and w are each independently of the others a number 0 or 1, and Y is as defined above. Preferably, E' is $C_2$-$C_4$alkylene or is 1,3- or 1,4-phenylene which is unsubstituted or substituted by sulfo, r is the number 1, s is the number 0, v is the number 1, and w is a number 0 or 1.

When A is the radical of an anthraquinone dye, it is preferably a radical of formula (10)

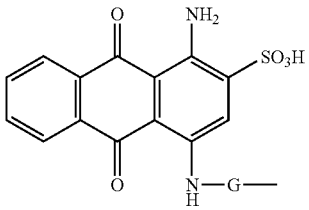

wherein G is a phenylene radical which is unsubstituted or substituted by $C_1$-$C_4$alkyl, $C_1$-$C_4$alkoxy, halogen, carboxy or by sulfo or is a cyclohexylene, phenylenemethylene or $C_2$-$C_6$alkylene radical, each of which preferably contains at least 2 sulfo groups. G is preferably a phenylene radical which is unsubstituted or substituted by $C_1$-$C_4$alkyl, $C_1$-$C_4$alkoxy, halogen, carboxy or by sulfo.

Special preference is given to A being a monoazo or disazo chromophore radical of formula (6a), (6b), (6d), (6e), (6f), (6g), (6h), (6i), (6j), (6k), (6m), (6o), (6r) or (6s) given above, a formazan radical of formula (7b) given above, or an anthraquinone radical of formula (10) given above, especially of formula (6a), (6b), (6e), (6g), (6h), (6i), (6j), (6k), (6m), (6s) or (10).

In the meanings given for the variables, $C_1$-$C_4$alkyl is generally methyl, ethyl, n- or iso-propyl or n-, iso-, sec- or tert-butyl. $C_1$-$C_4$Alkoxy is generally methoxy, ethoxy, n- or iso-propoxy or n-, iso-, sec- or tert-butoxy. Halogen is generally, for example, fluorine, chlorine or bromine. Examples of $C_1$-$C_4$alkoxycarbonyl are methoxycarbonyl and ethoxycarbonyl. Examples of $C_1$-$C_4$alkanoyl are acetyl, propionyl and butyryl. Examples of $C_2$-$C_4$alkanoylamino are acetylamino and propionylamino. Examples of $C_1$-$C_4$hydroxyalkoxy are hydroxymethoxy, β-hydroxyethoxy and β- and γ-hydroxypropoxy. Examples of $C_1$-$C_4$sulfatoalkoxy are sulfatomethoxy, β-sulfatoethoxy and β- and γ-sulfatopropoxy.

For the method according to the invention preference is given to the use of dyes of formula (1a) wherein $R_1$, X and A are as defined above and have the preferred meanings given above and V is a fibre-reactive substituent of formula (2a), (2b), (2c), (2d), (2e) or (2f) as defined above and having the preferred meanings given above.

The reactive dyes of formula (1) contain at least one, preferably at least two, sulfo group(s), which is/are either in the form of the free acid or, preferably, in the form of a salt thereof. Suitable salts are, for example, the alkali metal, alkaline earth metal or ammonium salts, salts of an organic amine or mixtures thereof. As examples there may be mentioned sodium, lithium, potassium or ammonium salts, the salt of mono-, di- or tri-ethanolamine or Na/Li or Na/Li/$NH_4$ mixed salts.

Dyes that are suitable for the method according to the invention correspond, for example, to formulae (1.1)

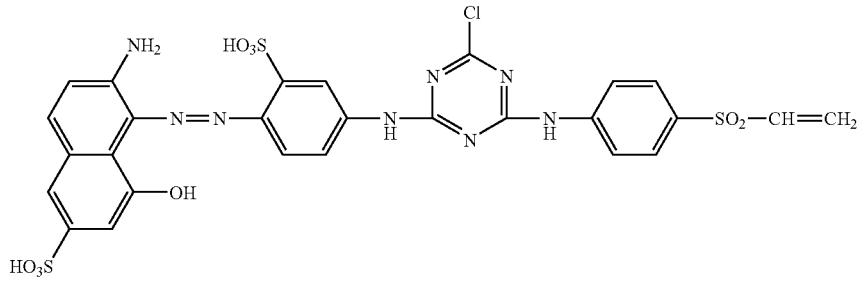

-continued
(1.2)
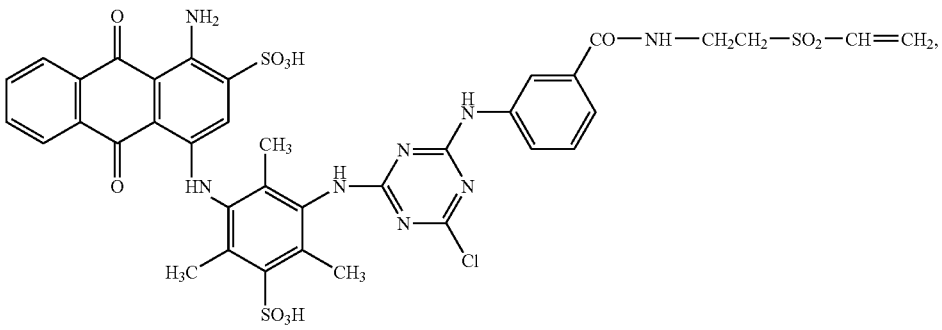
(1.3)
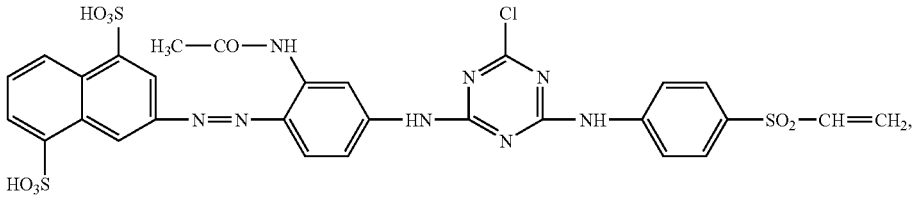
(1.4)
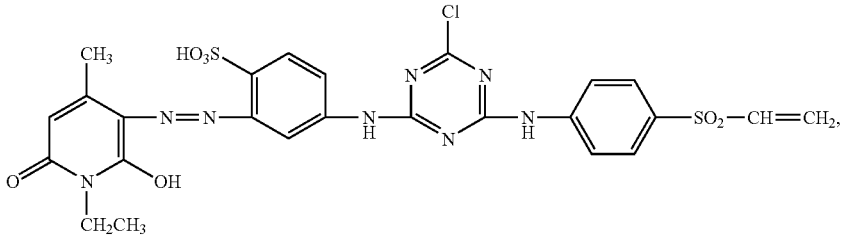
(1.5)
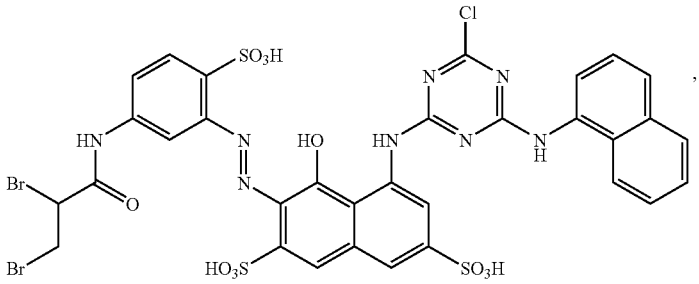
(1.6)
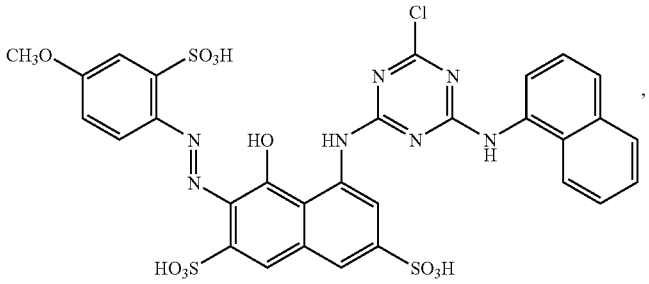
(1.7)
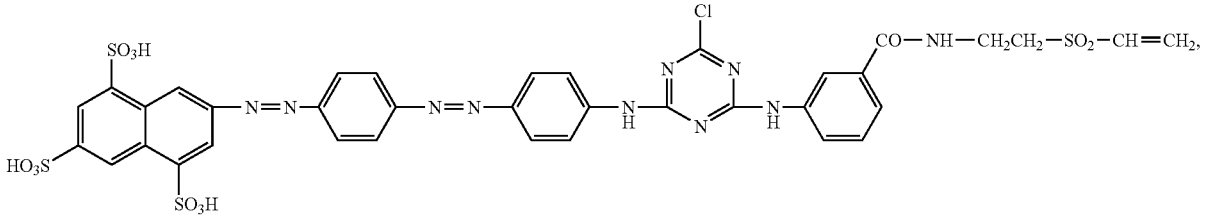

-continued
(1.8)
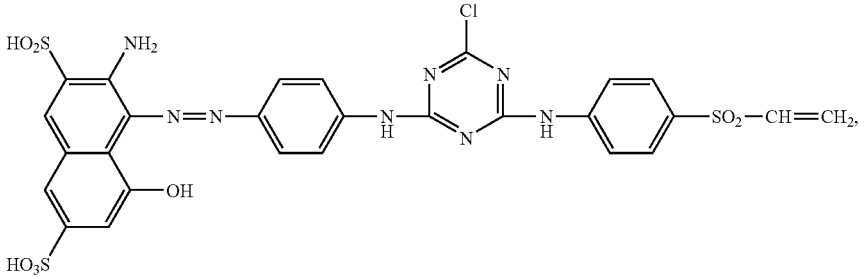
(1.9)
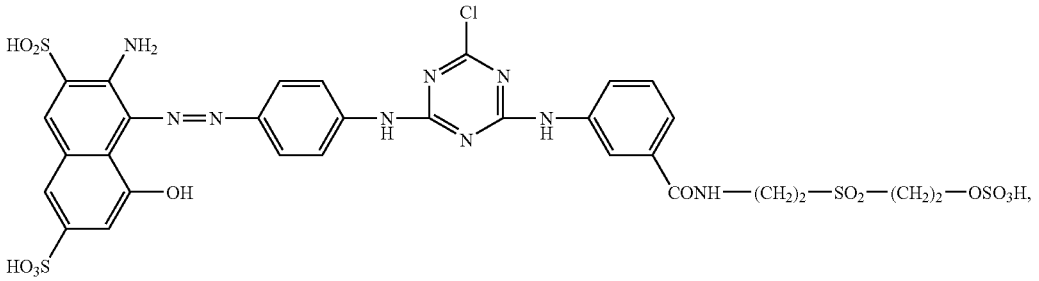
(1.10)
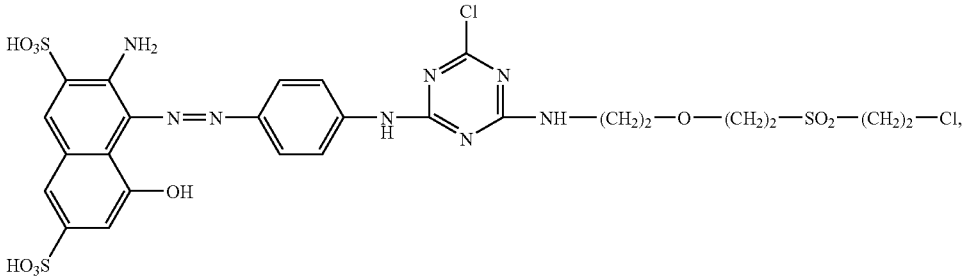
(1.11)
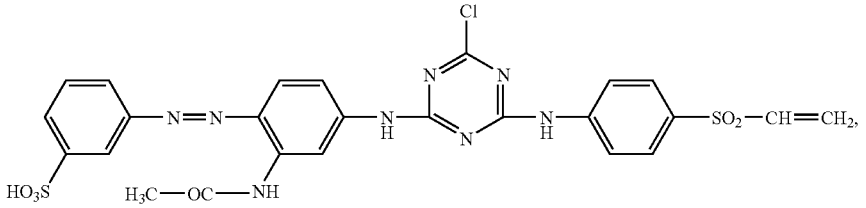
(1.12)
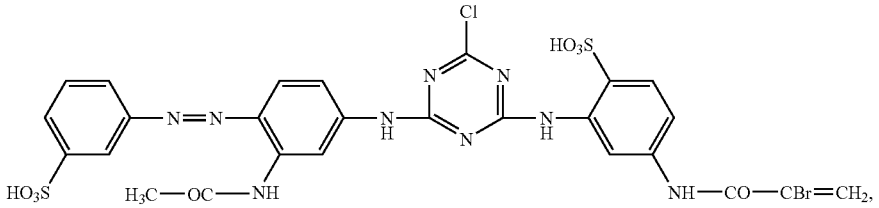
(1.13)
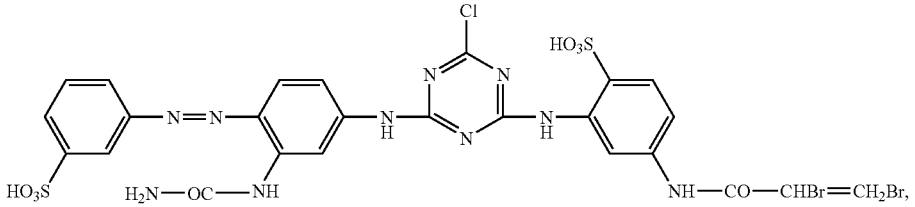

-continued
(1.14)
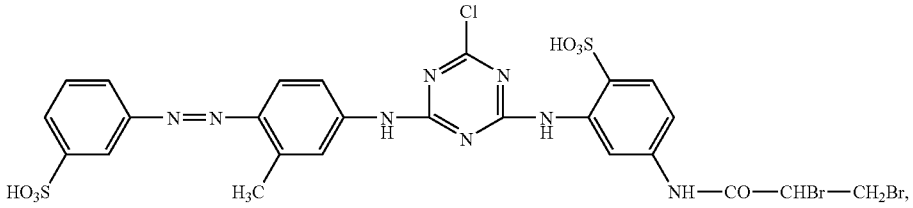
(1.15)
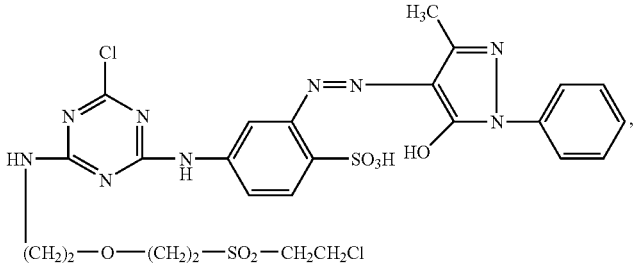
(1.16)
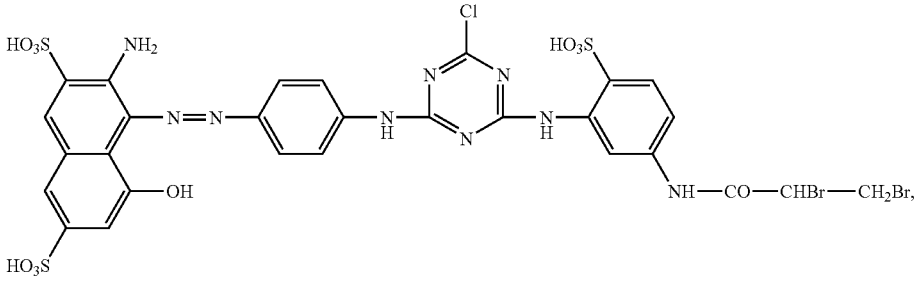
(1.17)
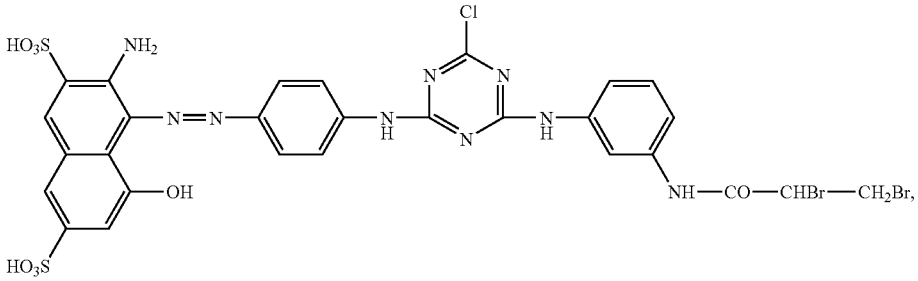
(1.18)
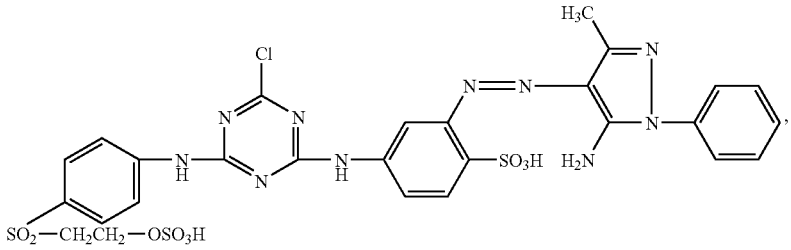
(1.19)
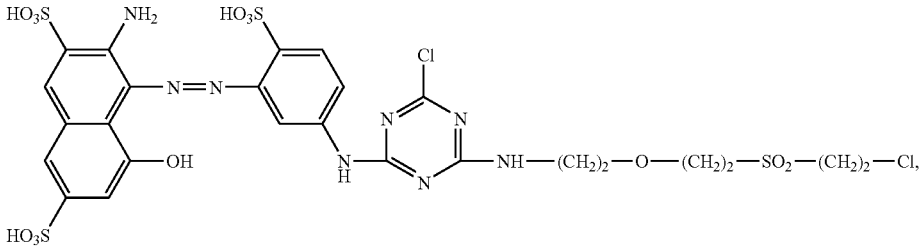

-continued (1.20)

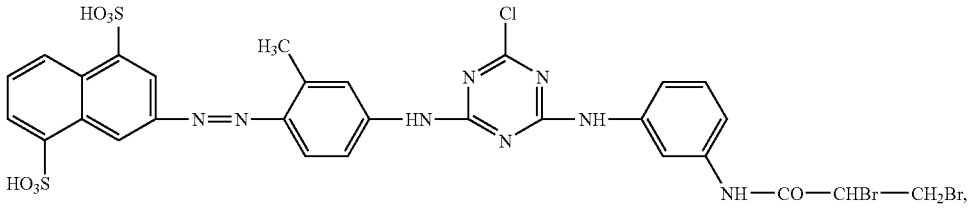

(1.21)

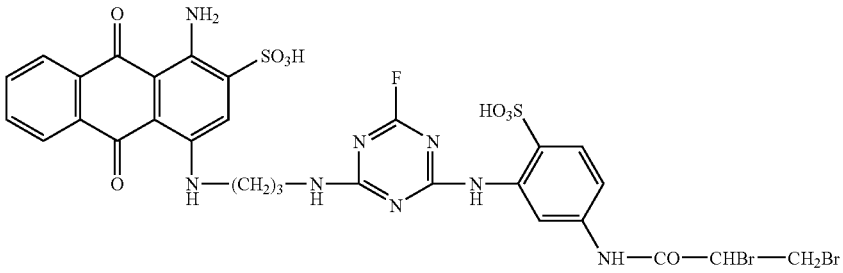

and (1.22)

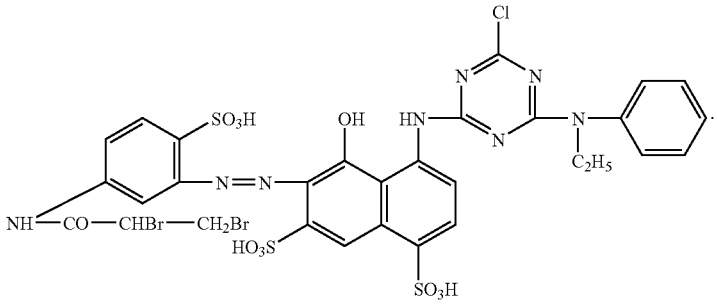

The reactive dyes used in the method according to the invention may comprise further additives such as, for example, sodium chloride or dextrin.

The dyes used in accordance with the invention are known or can be prepared using methods known per se, such as those described, for example, in U.S. Pat. Nos. 5,760,194, 5,760,195, 5,779,740 and EP-A-1 247 841.

For step a) of the method according to the invention, the customary dyeing or printing methods may be used. The dyeing liquors or printing pastes may comprise, in addition to water and the dyes, further additives, for example wetting agents, antifoams, levelling agents or agents that influence the characteristics of the textile material, for example softeners, flame-retardant additives, or dirt-, water- and oil-repellents, and also water-softeners and natural or synthetic thickeners, for example alginates and cellulose ethers.

The amounts in which the individual dyes are used in the dye baths or printing pastes can vary within wide limits depending on the required depth of shade; in general, amounts of from 0.01 to 15% by weight, especially from 0.1 to 10% by weight, based on the material to be dyed or the printing paste, have proved to be advantageous.

The dyes may be used singly, or mixtures of dyes, for example mixtures of two or three dyes (di- or tri-chromism), may be used.

In the case of woven carpet fabrics, printing methods such as, for example, displacement printing or space dyeing are of importance.

Preference is given to dyeing, which is carried out especially by the exhaust process and, in the case of carpet dyeing, can also be carried out by the continuous process.

Dyeing is preferably carried out at a pH of from 2 to 7, especially from 2.5 to 5.5, and very especially from 2.5 to 4. The liquor ratio can be selected within a wide range, for example from 1:5 to 1:50, preferably from 1:5 to 1:30. Dyeing is carried out at a temperature of preferably from 80 to 130° C., especially from 85 to 120° C.

In the method according to the invention, when a dye of formula (1) is used, there is no longer a requirement to carry out dyeing or printing in the presence of polycondensable or polymerisable monomers.

The after-treatment according to step b) is advantageously carried out at a pH of, for example, from 7 to 12, especially from 7 to 9, and at a temperature of, for example, from 30 to 100° C., especially from 50 to 80° C., in the presence of a reducing agent in the alkaline after-treatment bath. The pH is adjusted by adding the requisite amount of a suitable base, for example sodium hydroxide or sodium carbonate (soda). The dye components fixed in the polyamide fibre material are not adversely affected by the treatment.

Examples of suitable reducing agents are the following compounds:

lithium aluminium hydride, boron hydrides, thiosulfates, sulfites, sulfides, hydrosulfites, thiourea dioxide, sodium sulfoxylate formaldehyde, aldehydes, saccharides and, preferably, hydrosulfites or dithionites, e.g. sodium hydrosulfite or sodium dithionite.

The reducing agent is advantageously added in an amount of, for example, from 0.01 to 6% by weight, especially from 0.5 to 5% by weight, based on the weight of the after-treatment bath.

The method according to the invention is suitable for dyeing or printing synthetic polyamide fibre materials, such as, for example, polyamide-6(poly-ϵ-caprolactam), polyamide-6.6(polyhexamethyleneadipamide), polyamide-7, polyamide-6.12(polyhexamethylenedodecanoamide), polyamide-11 or polyamide-12, copolyamides with polyamide-6.6 or polyamide-6, for example polymers of hexamethylenediamine, ϵ-caprolactam and adipic acid and polymers of adipic acid, hexamethylenediamine and isophthalic acid or of adipic acid, hexamethylenediamine and 2-methylpentamethylenediamine or 2-ethyltetramethylenediamine, and is also suitable for dyeing or printing blend fabrics or yams of synthetic polyamide and wool.

The method according to the invention is advantageously also suitable for dyeing or printing microfibres of synthetic polyamides. Microfibres are understood to be fibre materials that are composed of threads having an individual thread fineness of less than 1 denier (1.1 dTex). Such microfibres are known and are usually produced by melt-spinning.

The said textile material can be in a very wide variety of processing forms, such as, for example, in the form of fibres, yarn, woven fabric, knitted fabric and in the form of carpets.

Dyeings with good all-round fastness properties, such as, for example, good fastness to chlorine, rubbing, wetting, wet-rubbing, washing, water, sea-water and perspiration, are obtained. Contact fastness properties especially, such as, for example, fastness to water and perspiration, exhibit very good values.

The Examples given hereinbelow are intended to illustrate the invention without limiting it to the Examples specifically mentioned.

EXAMPLE 1

130 kg of a swimwear tricot fabric consisting of 83% polyamide and 17% elastane fibres are treated in a beam dyeing apparatus, in a liquor ratio of 1:12, with a liquor comprising 0.35% by weight of the dye of formula (1.3) and 1.50% by weight of the dye of formula (1.5), based on the fibre material to be dyed. The pH of the liquor is adjusted to pH 3 using the requisite amount of citric acid (about 3% by weight, based on the fibre material to be dyed). The material to be dyed is heated at a rate of 1° C./min from 40° C. to 98° C. and dyed at that temperature for 60 min. The dyebath is then drained off, the material is rinsed once with warm water, and then after-treatment is carried out, for which purpose the dyed material is treated for 20 min at 70° C. in a fresh bath comprising 3 g of soda per liter and 5 g of hydrosulfite per liter. Rinsing with warm water is then carried out, followed by souring-off in a bath of dilute acetic acid (0.5 g per liter). A dyeing having excellent contact fastness properties, such as, for example, fastness to wetting and perspiration, is obtained.

EXAMPLE 2

80 kg of a corsetry fabric consisting of 80% polyamide and 20% elastane fibres are treated in a beam dyeing apparatus, in a liquor ratio of 1:15, with a liquor comprising 0.30% by weight of the dye of formula (1.3), 0.49% by weight of the dye of formula (1.5) and 1.96% by weight of the dye of formula (1.2), based on the fibre material to be dyed. The pH of the liquor is adjusted to pH 3 using the requisite amount of citric acid (about 3% by weight, based on the fibre material to be dyed). The material to be dyed is heated at a rate of 1° C./min from 40° C. to 98° C. and dyed at that temperature for 60 min. The dyebath is then drained off, the material is rinsed once with warm water, and then after-treatment is carried out, for which purpose the dyed material is treated for 20 min at 70° C. in a fresh bath comprising 2 g of soda per liter and 3 g of hydrosulfite per liter. Rinsing with warm water is then carried out, followed by souring-off in a bath of dilute acetic acid (0.5 g per liter). A dyeing having excellent contact fastness properties, such as, for example, fastness to wetting and perspiration, is obtained.

EXAMPLE 3

70 kg of a fabric of polyamide-6.6 microfibres are treated for 10 min at 40° C. in a dyeing apparatus with 1500 liters of liquor comprising 3 kg of formic acid, 0.4 kg of wetting agent and 0.7 kg of a levelling agent. The pH of the liquor is 2.9. There are then added, pre-dissolved in a small amount of water, 700 g of the dye of formula (1.3), 1300 g of the dye of formula (1.1) and 430 g of the dye of formula (1.2). The material to be dyed is treated in the dyeing liquor for 5 min at 40° C., is then heated at a rate of 1° C./min to 110° C. and dyed at that temperature for 60 min. The dyebath is then drained off, the material is rinsed once with warm water, and then after-treatment is carried out, for which purpose the dyed material is treated for 20 min at 70° C. in a fresh bath comprising 2 g of soda per liter and 5 g of hydrosulfite per liter and having a pH of 9.2. Rinsing and finishing are then carried out in customary manner. A dyeing having excellent contact fastness properties, such as, for example, fastness to wetting and perspiration, is obtained.

EXAMPLE 4

A polyamide fibre material or a blend fabric of polyamide/elastane is treated in a laboratory dyeing apparatus, in a liquor ratio of 1:20, with a liquor comprising 0.30% by weight of the dye of formula (1.3), 0.50% by weight of the dye of formula (1.1) and 2.00% by weight of the dye of formula (1.2), based on the fibre material to be dyed. The pH of the liquor is adjusted to pH 3 using the requisite amount of citric acid (about 3% by weight, based on the fibre material to be dyed). The material to be dyed is heated at a rate of 1° C./min from 40° C. to 98° C. and dyed at that temperature for 60 min. The dyebath is then drained off, the material is rinsed once with warm water, and then after-treatment is carried out, for which purpose the dyed material is treated for 20 min at 70° C. in a fresh bath comprising 2 g of soda per liter and 3 g of hydrosulfite per liter. Rinsing with warm water is then carried out, followed by souring-off in a bath of dilute acetic acid (0.5 g per liter). A dyeing having excellent contact fastness properties, such as, for example, fastness to wetting and perspiration, is obtained.

EXAMPLES 5 to 7

Dyeings having excellent contact fastness properties are likewise obtained by proceeding as described in Example 4 but using the dyes indicated below instead of 0.30% by weight of the dye of formula (1.3), 0.50% by weight of the dye of formula (1.1) and 2.00% by weight of the dye of formula (1.2):

EXAMPLE

| Example | |
|---|---|
| 5 | 0.85% by weight of the dye of formula (1.3)<br>2.60% by weight of the dye of formula (1.5) |
| 6 | 0.35% by weight of the dye of formula (1.3)<br>1.50% by weight of the dye of formula (1.5)<br>0.05% by weight of the dye of formula (1.2) |
| 7 | 0.10% by weight of the dye of formula (1.6)<br>2.00% by weight of the dye of formula (1.2) |

What is claimed is:

1. A method of dyeing or printing synthetic polyamide fibre materials, wherein (a) the fibre material is dyed or printed with at least one reactive dye, and (b) the dyed or printed fibre material is subjected to after-treatment with a reducing agent, the fibre material not being treated with polycondensable or polymerisable compounds for fixing the dye on the fibre, and wherein blend fibres of polyester and polyamide are excluded, and wherein the at least one reactive dye is a reactive dye of formula (1a)

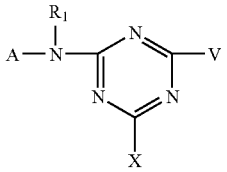

wherein $R_1$ is hydrogen or unsubstituted or substituted $C_1$-$C_4$ alkyl,

X is halogen,

A is the radical of a monoazo, disazo, polyazo, metal complex azo, anthraquinone, phthalocyanine, formazan or dioxazine dye, and V is a non-fibre-reactive substituent or is a fibre-reactive substituent of formula (2a)

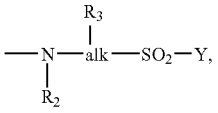

(2b)

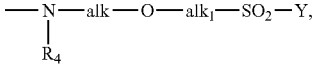

-continued (2c)

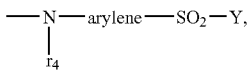

(2d)

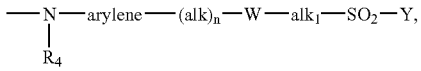

(2e)

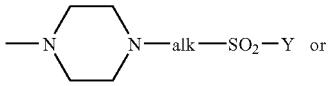

or (2f)

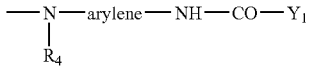

wherein $R_2$ is hydrogen or unsubstituted or substituted $C_1$-$C_4$ alkyl or a radical

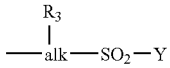

wherein $R_3$ is as defined below, $R_3$ is hydrogen, hydroxy, sulfo, sulfato, carboxy, cyano, halogen, $C_1$-$C_4$ alkoxycarbonyl, $C_1$-$C_4$ alkanoyloxy, carbamoyl or a group —$SO_2$—Y, $R_4$ is hydrogen or $C_1$-$C_4$ alkyl, alk and $alk_1$ are each independently of the other linear or branched $C_1$-$C_6$ alkylene, arylene is a phenylene or naphthylene radical which is unsubstituted or substituted by sulfo, carboxy, hydroxy, $C_1$-$C_4$ alkyl, $C_1$-$C_4$ alkoxy or by halogen, Y is vinyl or a radical —-$CH_2$—$CH_2$-U and U is a leaving group, $Y_1$ is a group —CH(Hal)-$CH_2$(Hal) or —C(Hal)=$CH_2$ wherein Hal is chlorine or bromine, W is a group —$SO_2$—$NR_4$—, —$CONR_4$— or —$NR_4CO$— wherein $R_4$ is as defined above, Q is a radical —O— or —$NR_4$— wherein $R_4$ is as defined above, and n is a number 0 or 1.

2. A method according to claim 1, wherein $R_1$ is hydrogen.

3. A method according claim 1, wherein

X is chlorine.

4. A method according to claim 1, wherein

V is a fibre-reactive substituent of formula (2a), (2b), (2c), (2d), (2e) or (2f) wherein $R_2$, $R_3$, $R_4$, alk, $alk_1$, arylene, Y, $Y_1$, W, Q and n are as defined in claim 1.

5. A method according to claim 1, wherein hydrosulfite is used as reducing agent.

6. A method according to claim 1, wherein the after-treatment is carried out at a pH of from 7 to 12 and at a temperature of from 30 to 100° C.

* * * * *